US010662544B2

(12) United States Patent
Peng et al.

(10) Patent No.: US 10,662,544 B2
(45) Date of Patent: May 26, 2020

(54) SURFACE TREATMENT PROCESS FOR METAL ARTICLE

(71) Applicants: HONGFUJIN PRECISION ELECTRONICS (CHENGDU) Co., Ltd., Chengdu (CN); HON HAI PRECISION INDUSTRY CO., LTD., New Taipei (TW)

(72) Inventors: Xiao-Gang Peng, Shenzhen (CN); Kai Fang, Shenzhen (CN); Yong-De Pei, Shenzhen (CN); Cheng-Bin Bai, Shenzhen (CN); Wei Liu, Shenzhen (CN); Qi Wang, Shenzhen (CN)

(73) Assignees: HONGFUJIN PRECISION ELECTRONICS (CHENGDU) Co., Ltd., Chengdu (CN); HON HAI PRECISION INDUSTRY CO., LTD., New Taipei (TW)

( * ) Notice: Subject to any disclaimer, the term of this patent is extended or adjusted under 35 U.S.C. 154(b) by 45 days.

(21) Appl. No.: 15/863,997

(22) Filed: Jan. 8, 2018

(65) Prior Publication Data

US 2019/0161882 A1 May 30, 2019

(30) Foreign Application Priority Data

Nov. 24, 2017 (CN) ..... 2017 1 1192682

(51) Int. Cl.
*C25D 5/34* (2006.01)
*C25D 5/38* (2006.01)
(Continued)

(52) U.S. Cl.
CPC ..... *C25D 11/243* (2013.01); *C25D 11/16* (2013.01); *C25D 11/246* (2013.01); *C25D 11/26* (2013.01); *C25D 11/30* (2013.01); *C25D 11/08* (2013.01)

(58) Field of Classification Search
CPC ... C25D 5/34; C25D 5/38; C25D 5/44; C25D 5/48; C25D 5/52; C25D 11/02;
(Continued)

(56) References Cited

U.S. PATENT DOCUMENTS 2,927,872 A * 3/1960 Cohn ..... C25D 11/243 148/244
4,068,018 A * 1/1978 Hashimoto ..... G03F 1/56 430/5
(Continued)

FOREIGN PATENT DOCUMENTS

CN 105239129 A * 1/2016 ..... C25D 11/12
CN 106867275 A * 6/2017 ..... C09B 67/22

OTHER PUBLICATIONS

Stevenson, Jr., "Anodizing," ASM Handbook, vol. 5: Surface Engineering (© 1994), pp. 482-493. (Year: 1994).*

*Primary Examiner* — Edna Wong
(74) *Attorney, Agent, or Firm* — ScienBiziP, P.C.

(57) ABSTRACT

A surface treatment process for a metal article provides a uniform and unblemished surface finish to the metal article. The surface treatment process anodizes the metal article to form an anodic oxide layer on a surface, and the metal article is activated using a pre-dyeing solution. The pre-dyeing solution contains complex organic acid and sodium acetate. The anodic oxide layer of the metal article is dyed for color and the dyed anodic oxide layer of the metal article is finally sealed.

13 Claims, 1 Drawing Sheet

(51) Int. Cl.

| | |
|---|---|
| ***C25D 5/44*** | (2006.01) |
| ***C25D 5/48*** | (2006.01) |
| ***C25D 5/52*** | (2006.01) |
| ***C25D 11/02*** | (2006.01) |
| ***C25D 11/06*** | (2006.01) |
| ***C25D 11/14*** | (2006.01) |
| ***C25D 11/16*** | (2006.01) |
| ***C25D 11/18*** | (2006.01) |
| ***C25D 11/24*** | (2006.01) |
| ***C25D 11/26*** | (2006.01) |
| ***C25D 11/30*** | (2006.01) |
| *C25D 11/08* | (2006.01) |

(58) Field of Classification Search

CPC ..... C25D 11/08; C25D 11/14; C25D 11/16; C25D 11/18; C25D 11/24; C25D 11/26; C25D 11/30; C25D 11/243; C25D 11/246

USPC ..... 205/199, 200, 202, 206, 210, 212, 213, 205/329

See application file for complete search history.

(56) References Cited

U.S. PATENT DOCUMENTS

| | | | | |
|---|---|---|---|---|
| 4,409,999 | A * | 10/1983 | Pedziwiatr | B08B 3/12 134/184 |
| 6,797,016 | B1 * | 9/2004 | Schofberger | C09B 67/0073 8/506 |
| 2010/0215926 | A1 * | 8/2010 | Askin | C25D 11/18 428/209 |
| 2013/0270120 | A1 * | 10/2013 | Yao | C25D 11/16 205/50 |

* cited by examiner

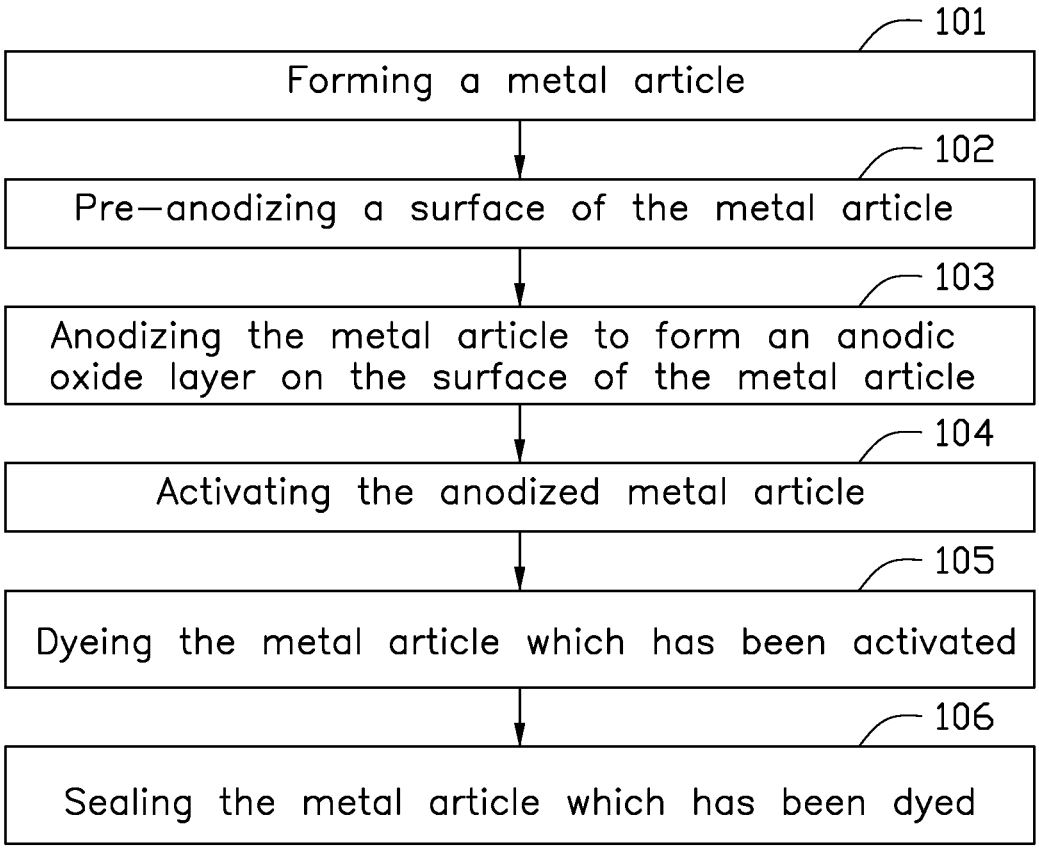
101
Forming a metal article
102
Pre-anodizing a surface of the metal article
103
Anodizing the metal article to form an anodic oxide layer on the surface of the metal article
104
Activating the anodized metal article
105
Dyeing the metal article which has been activated
106
Sealing the metal article which has been dyed

SURFACE TREATMENT PROCESS FOR METAL ARTICLE

CROSS-REFERENCE TO RELATED APPLICATIONS

This application claims priority to Chinese Patent Application No. 201711192682.0 filed on Nov. 24, 2017, the contents of which are incorporated by reference herein.

FIELD

The disclosure relates to surface treatment processes and, particularly, to an anodizing and dyeing process for a metal article.

BACKGROUND

Metal articles made of, e.g., aluminum, magnesium, titanium, or alloys thereof, with a high-quality mechanical performance have applications in many industries. The articles usually need to be processed to form anodic oxide films via surface treatment process for improving corrosion resistance or abrasion resistance thereof. The anodic oxide films are often subsequently colored to obtain desired decorative appearances. The coloring of the metal articles can be carried out by submersion in a dye solution or otherwise applying a dye thereto. However, during coloring the metal articles, acidic solution used in surface treatment process may flow into holes or slits in the metal articles, and thus cause cloudiness in regions of the anodic oxide film.

BRIEF DESCRIPTION OF THE DRAWING

Implementations of the present technology will now be described, by way of example only, with reference to the attached FIGURE.

The FIG. 1 is a flow chart of a surface treatment process for a metal article, in accordance with a present embodiment.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "inside" indicates that at least a portion of a region is partially contained within a boundary formed by the object. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising" when utilized, means "including, but not necessarily limited to"; it specifically indicates open-ended inclusion or membership in the so-described combination, group, series, and the like.

Referring to FIG. 1, a flowchart is presented in accordance with an example embodiment of a surface treatment process for a metal article. The metal article can be made of aluminum, aluminum alloy, magnesium, magnesium alloy, titanium, or titanium alloy. The example method is provided by way of example, as there are a variety of ways to carry out the method. Each block shown in FIG. 1 represents one or more processes, methods or subroutines, carried out in the example method. Additionally, the illustrated order of blocks is by example only and the order of the blocks can change. The example method can begin at block 101.

At block 101, a metal article is formed. The metal article can be made by punching, molding, or other methods. In at least one embodiment, the metal article can be made by punching aluminum alloy materials using a forging press. After the metal article is formed, a surface of the metal article can be subjected to mechanical polishing to achieve a bright, smooth mirror effect. In at least one embodiment, the metal article can be further subjected to sand blasting to achieve elegant appearance.

In other embodiments, a shaped metal article can be provided, and the step at block 101 can be omitted.

At block 102, the metal article is subjected to one or more pre-anodizing treatments, for removing grease residues or a native oxide layer from the surface of the metal article. The one or more pre-anodizing treatments may include one or more of degreasing, desmutting, and chemical polishing.

A process for degreasing is performed using an alkaline solution, such as sodium pyrophosphate solution. A concentration of the sodium pyrophosphate solution is in an approximate range from 45 g/L to 55 g/L, and the degreasing process is carried out at a temperature in an approximate range from 47° C. to 53° C. for about 2 minutes to 5 minutes.

A process for desmutting is performed using a strong acid solution. In at least one embodiment, desmutting is performed in a desmutting solution containing nitric acid with a concentration of about 68% for about 50 seconds to about 70 seconds. A mass percent of the nitric acid is in a range from about 10 percent to about 15 percent. The desmutting solution further contains a desmutting agent with a mass percent of about 5 percent to 10 percent.

A process for chemical polishing is performed using a chemical polishing solution containing sulfuric acid, phosphoric acid, and an additive. A mass ratio of the sulfuric acid and the phosphoric acid is in an approximate range from 1:3 to 1:4. In at least one embodiment, a mass ratio of the sulfuric acid, the phosphoric acid, and the additive is 1:3.58:0.92. An aluminum ion concentration in a polishing tank is about 15 g/L. Chemical polishing is performed at a temperature in an approximate range from 70° C. to 90° C. for about 50 seconds to 90 seconds. In other embodiments, the aluminum ion concentration in the polishing tank is more than 15 g/L and less than 25 g/L.

It is to be understood that, additionally or alternatively, other solutions, could be employed in the process at block 102.

It is to be understood that, if the surface of the metal article is altogether clean, the process at block 102 can be omitted.

At block 103, an anodizing process is then performed upon the surface of the metal article. As such, an anodic oxide layer with a plurality of fine pores therein is formed on the surface of the metal article.

The anodizing process is carried out in an anodizing solution. In at least one embodiment, the anodizing solution is sulfuric acid solution with a concentration in an approximate range from 210 g/L to 220 g/L. A voltage in an approximate range from 14 volts to 16 volts is applied to the metal article. The metal article is anodized in the anodizing solution at a current density of about 0.9 to about 1.1 milliamperes per square centimeter and at a temperature in an approximate range from 17° C. to 19° C. for about 20 minutes to about 50 minutes. In at least one embodiment, the anodizing process is performed for about 32 minutes to about 36 minutes.

At block 104, the anodized metal article is subjected to an active treatment.

As the metal article may include through holes, blind holes, and slits, the anodizing solution may flow into holes or slits in the metal article in the anodizing process. Therefore, the metal article is immersed into a pre-dyeing solution for active treatment, so as to remove the anodizing solution remained in the holes or slits in the metal article.

In at least one embodiment, a mass concentration of the pre-dyeing solution is about 190 g/L to 210 g/L. The pre-dyeing solution contains complex organic acid and sodium acetate. A volume ratio of the complex organic acid is in an approximate range from 55% to 76%, and a volume ratio of the sodium acetate is in an approximate range from 24% to 45%. The active treatment is performed in room temperature for about 2 minutes to about 4 minutes. After the active treatment, the metal article is rinsed by water, so as to remove the pre-dyeing solution. The pre-dyeing solution can remove the anodizing solution remaining in the metal article, and the pre-dyeing solution is easy to remove in water.

In at least one embodiment, the metal article is rinsed by ultrasonic wave treatment after the active treatment, so as to remove the anodizing solution remaining in the metal article.

At block 105, the anodized metal article is immersed into a dye solution containing an organic dye, so as to color the surface of the anodized metal article. During the coloring of the anodized metal article, the organic dye in the dye solution penetrates into the pores of the anodic oxide layer of the anodized metal article, thus coloring anodic oxide layer on the surface of the anodized metal article. In at least one embodiment, the dyeing process is performed at a temperature in an approximate range from 40° C. to 50° C. for about 4 minutes to 5 minutes.

In at least one embodiment, the dyeing solution contains two kinds of black dyes and one red dye, and the surface of the metal article is thus colored to be gray. For example, the dye solution contains a first black dye in a concentration of about 0.96 g/L, a second black dye in a concentration of about 0.26 g/L, and a red dye in a concentration of about 0.02 g/L.

As pH value has an important impact on dyeing quality, the dyeing solution further contains a stabilizing agent. In at least one embodiment, the stabilizing agent is nickel acetate, and a concentration of the nickel acetate in the dyeing solution is in an approximate range from 10 g/L to 15 g/L. The value of the dyeing solution is in an approximate range from 5.3 to 5.8.

At block 106, the anodized metal article is processed in a sealing process to seal the dyed anodic oxide layer. The sealing process is carried out in a sealing solution, such that a sealing agent in the sealing solution can seal the pores in the dyed anodic oxide layer of the anodized metal article. The anodized metal article will thus have a high corrosion resistance and abrasion resistance after the sealing process.

In at least one embodiment, the sealing solution contains nickel acetate with a concentration of about 10 g/L to about 15 g/L. The sealing process is performed for more than 20 minutes, with the sealing solution being maintained about at a temperature of about 90° C. to about 96° C. It is to be understood that, the sealing solution may contain other sealing agent, such as nickel sulfate, or cobalt sulfate.

In at least one embodiment, the metal article is processed in a drying process after the dyeing process. The drying process is performed for 8 minutes to 12 minutes at a temperature of 90° C. to 96° C.

It can be understood that, the metal article can be rinsed by water between the processes.

In the surface treatment process for the metal article, the metal article is subjected to active treatment before the dyeing process, thus the residual anodizing solution in the holes or slits of the metal article can be removed. Therefore, the dyeing quality is improved and spots are avoided, and a colored metal article with good wear/durability characteristics and bright luster is obtained.

The embodiments shown and described above are only examples. Many details are often found in the art such as the other features of a surface treatment of metal article. Therefore, many such details are neither shown nor described. Even though numerous characteristics and advantages of the present technology have been set forth in the foregoing description, together with details of the structure and function of the present disclosure, the disclosure is illustrative only, and changes may be made in the details, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A surface treatment process for a metal article, comprising the steps of:

anodizing the metal article in sulfuric acid solution to form an anodic oxide layer on a surface of the metal article;

activating the anodized metal article using a pre-dyeing solution to remove the sulfuric acid solution remaining on the anodized metal article, the pre-dyeing solution containing complex organic acid and sodium acetate, a volume ratio of the complex organic acid being in an approximate range from 55% to 76%, and a volume ratio of the sodium acetate being in an approximate range from 24% to 45%;

dyeing the metal article which has been activated; and sealing the metal article which has been dyed.

2. The surface treatment process as claimed in claim 1, wherein the process further comprises rinsing the anodized metal article by ultrasonic wave after activating the anodized metal article.

3. The surface treatment process as claimed in claim 1, wherein a method of dyeing the metal article comprising dyeing the metal article which has been activated in a dyeing solution comprising an organic dye and a stabilizing agent, and a pH value of the dyeing solution is in an approximate range from 5.3 to 5.8.

4. The surface treatment process as claimed in claim 3, wherein the stabilizing agent is nickel acetate, and a concentration of the nickel acetate in the dyeing solution is in an approximate range from 10 g/L to 15 g/L.

5. The surface treatment process as claimed in claim 1, further comprising pre-treating the metal article by a pre-anodizing treatment before anodizing the surface of the metal article.

6. The surface treatment process as claimed in claim 5, wherein the pre-anodizing treatment comprises at least one of degreasing, desmutting, and chemical polishing.

7. The surface treatment process as claimed in claim 6, wherein a process for the desmutting is performed by using nitric acid solution.

8. The surface treatment process as claimed in claim 6, wherein a process for the chemical polishing is performed by using a chemical polishing solution containing sulfuric acid, phosphoric acid, and an additive, at a temperature in an approximate range from 70° C. to 90° C. for about 50 seconds to 90 seconds.

9. The surface treatment process as claimed in claim 1 the process further comprising forming the metal article by punching aluminum alloy materials with a forging press, before anodizing the metal article.

10. The surface treatment process as claimed in claim 1, wherein anodizing the surface of the metal article is performed in the sulfuric acid solution with a concentration in an approximate range from 210 g/L to 220 g/L.

11. The surface treatment process as claimed in claim 10, wherein a method of anodizing the metal article comprises anodizing the metal article in the sulfuric acid solution at a current density of 0.9 to 1.1 milliamperes per square centimeter, with at voltage in an approximate range from 14 volts to 16 volts applied thereto.

12. The surface treatment process as claimed in claim 11, wherein the metal article is anodized in the sulfuric acid solution at a temperature in an approximate range from 17° C. to 19° C. for about 20 minutes to 50 minutes.

13. The surface treatment process as claimed in claim 1, wherein the metal article is made of aluminum, aluminum alloy, magnesium, magnesium alloy, titanium, or titanium alloy.

* * * * *